United States Patent [19]

Konishi et al.

[11] 4,182,042

[45] Jan. 8, 1980

[54] MARKING DEVICE

[75] Inventors: Kazunori Konishi, Kobe; Hiromu Wakayama, Akashi; Toshihiro Nagatani; Fumio Eto, both of Kobe, all of Japan

[73] Assignee: Kobe Steel, Ltd., Kobe, Japan

[21] Appl. No.: 919,567

[22] Filed: Jun. 27, 1978

[30] Foreign Application Priority Data

Jun. 27, 1977 [JP] Japan ..... 52-76918

[51] Int. Cl.[2] ..... B43L 13/00

[52] U.S. Cl. ..... 33/18 R

[58] Field of Search ..... 33/1 M, 18 R, 21, 34, 33/35

[56] References Cited

U.S. PATENT DOCUMENTS

| | | | |
|---|---|---|---|
| 2,437,025 | 3/1948 | Hatten | 33/21 C |
| 2,701,417 | 2/1955 | Grahm | 33/35 X |
| 2,922,332 | 1/1960 | Lentz et al. | 33/1 M X |
| 3,129,512 | 4/1964 | Schiler | 33/18 R |

*Primary Examiner*—Charles E. Phillips

*Attorney, Agent, or Firm*—Oblon, Fisher, Spivak, McClelland & Maier

[57] ABSTRACT

A marking device is described which includes a guide post having a guide surface and inclined to the vertical plane, a horizontal arm carried by the guide post and movable up and down along said guide surface, a detector for detecting the material on which the marking is to be effected and carried by the horizontal arm, movable back and forth in the direction perpendicular to the material, a crosshead movable along the length of the horizontal arm, a marking head carried by the crosshead movable in the direction perpendicular to the direction in which the crosshead, is moved and a marking member carried by the marking head, movable in the direction perpendicular to the directions in which the crosshead and the marking head are moved, respectively.

1 Claim, 10 Drawing Figures

MARKING DEVICE

BACKGROUND OF THE INVENTION

1. Field of the Invention

This invention generally relates to a marking device, and more particularly to a marking device for use in effecting marking on the surface of coil which has been rolled.

2. Description of the Prior Art

Strip coils of various qualities and diameters are produced in rolling mills. In some cases, strip coils having the same shape and size but having different qualities are produced by the same rolling line. Since they cannot be apparently distinguished from each other, it is often experienced that they are mixed with each other so as to pose a serious problem in subsequent steps.

The most common measure for avoiding this inconvenience is to put specific marks on a predetermined portion of the outer peripheral surfaces of the strip coils immediately after the delivery from the strip mill, so as to make the strip coils of different qualities distinguishable from each other.

One of the conventional methods of putting the marks is the so-called stencil method in which a stencil made of a metallic plate or a sheet of paper, from which the pattern of the mark such as letters or numerals have been punched out, is placed on the material to be marked and then paint is sprayed over the stencil. Another conventional method is the so-called stamping method, according to which a stamp carrying the desired marking pattern is pressed against the surface of the material.

These conventional marking methods are, however, inconvenient in that they necessitate a quick-drying paint or ink. The stable and continuous supply of such a quick-drying marking material is extremely difficult. Further, the first mentioned stencil method requires cleaning of the used stencils. Conventionally, this cleaning work has been made by means of a specific cleaning mechanism which is highly complicated and apt to suffer breakdowns requiring a number of maintenance operators. At the same time, the demand for automatic marking operation is increasing, because marking on the hot strip coils soon after the delivery from the strip mill is extremely severe problem and dangerous.

Under these circumstances, the present invention aims at providing an automatic marking device which can automatically perform a marking on the desired portion of the material, even when the material is still hot and even when the diameters of the materials are varied, without requiring maintenance by operators, whose presence have been necessitated in conventional marking work, and the severe problems and dangerous manual marking work under a high temperature is avoided, thereby overcoming the above stated problems of the prior art.

SUMMARY OF THE INVENTION

Accordingly, the object of the present invention to provide a marking device which can automatically perform a marking on the desired portion of the material, even when the material is still hot and even when the diameters are varied, without requiring the presence of a skilled operator.

The above and the other objects are achieved by a marking device which comprises a guide post having a guide surface inclined to the vertical plane, a horizontal arm carried by said guide post and movable up and down along said guide surface, a detector for detecting the material on which the marking is to be effected and carried by said horizontal arm, movable back and forth in the direction perpendicular to said material, a crosshead movable along the length of said horizontal arm, a marking head carried by said crosshead movable in the direction perpendicular to the direction in which said crosshead is moved and a marking member member carried by said marking head movable in the direction perpendicular to the directions in which said crosshead and said marking head are moved, respectively.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
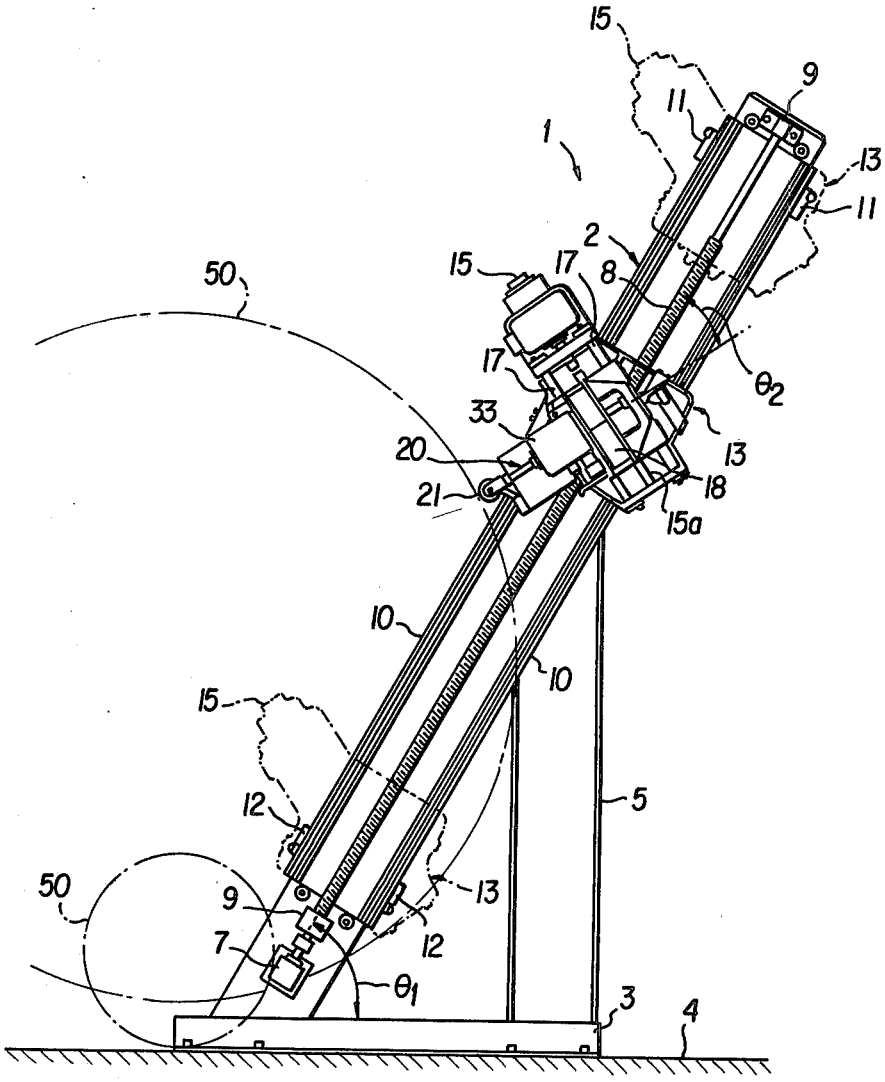
FIG. 1 shows the marking device in accordance with the invention.
Figure 2:
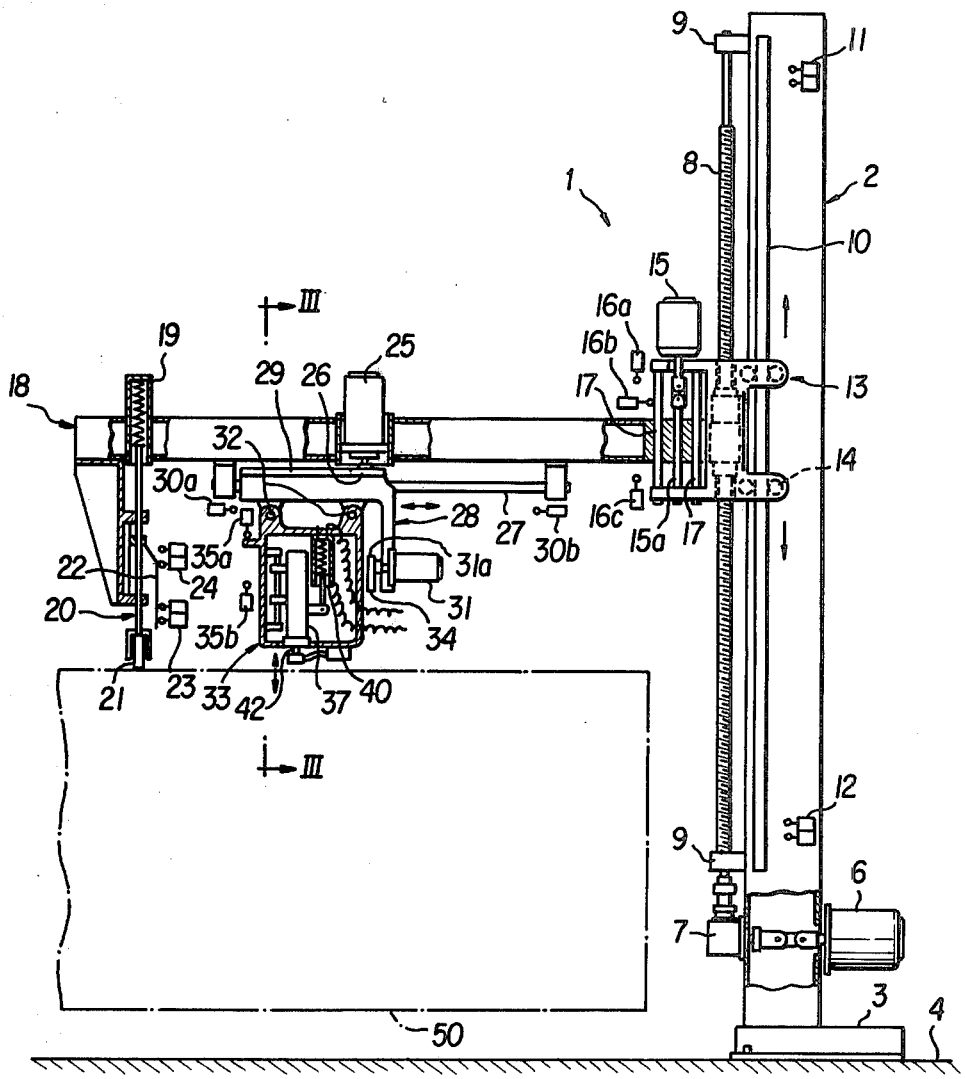
FIG. 2 is a side elevational view of the marking device as shown in FIG. 1.

The present invention will be hereinafter described in detail with reference to the accompanied drawings. Referring first to FIGS. 1 to 4 showing an embodiment of the inventon, a marking device of the invention generally denoted by 1 is constituted mainly by a guide post 2, a horizontal arm 18, a detector 20 for detecting the material on which the mark is to be placed, a crosshead 28, a marking head 33 and a marking member 42.

The guide post 2 is placed on a bed 3 which is fixed to the floor 4 at an inclination to the vertical plane. The angle $\theta_1$ formed between the guide post 2 and the top surface of the bed 3 is 67.5°. A motor 6 for moving the horizontal arm 18 up and down is disposed at the lower end portion of the guide post 2. The motor 6 is operatively connected through a gear box 7 to a screw shaft 8 which is supported at both ends thereof by the guide post 2. The guide post 2 is provided at both sides with guide projections 10,10 which extend along the length of the guide post 2. An upper and a lower limit switch 11 and 12 are attached to the upper and lower ends of the guide post.

The marking device further has a carriage 13 engaging the screw shaft 8 and having rollers cramping the guide projections 10. The carriage 13 carries a line-shifting motor 15 and three limit switches 16*a*, 16*b* and 16*c*.

The aforementioned horizontal arm 2 is carried by the carriage 13 slidably through a guide rod 17. The horizontal arm 18 engages the screw 15*a* formed at the end of the shaft of the motor 15, so as to be moved up and down. The detector 18 for detecting the material, provided at its end with a roller 21, is carried by the end of the horizontal arm 18 through a spring 19, movable back and forth. The detector 20 is inclined downwardly such that it makes an angle $\theta_2$, which is 22.5°, to the axis of the guide post 2(45° to the horizontal plane). Limit switches 23,24 are disposed in the vicinity of a lever 22 fixed to the detector 20.

The horizontal arm 18 carries at its intermediate portion a motor for causing x-axis directional movement of the aforementioned crosshead 28. The crosshead 28 is mounted on the intermediate portion of the horizontal shaft movably in the longitudinal direction, i.e. in the direction of the x-axis. The crosshead 28 has a rack 29 which engages a pinion 26 of the above-mentioned motor 25. Limit switches 30*a*,30*b* are secured to both end portions of the guide shaft 27 through which the crosshead 28 is carried by the horizontal arm 18.

The crosshead 28 is provided with a motor 31 for causing a y-axis directional movement. Also, the aforementioned marking head 33 is carried by the crosshead 28 through a guide shaft 32, movable in the direction (y-axis direction) perpendicular to the direction of movement of the crosshead 28. The marking head 33 is provided with a rack 34 which is in engagement with a pinion 31*a* of the above-mentioned motor 31. Limit switches 35*a*,35*b* are disposed in the vicinity of the marking head 33.

Figure 3:
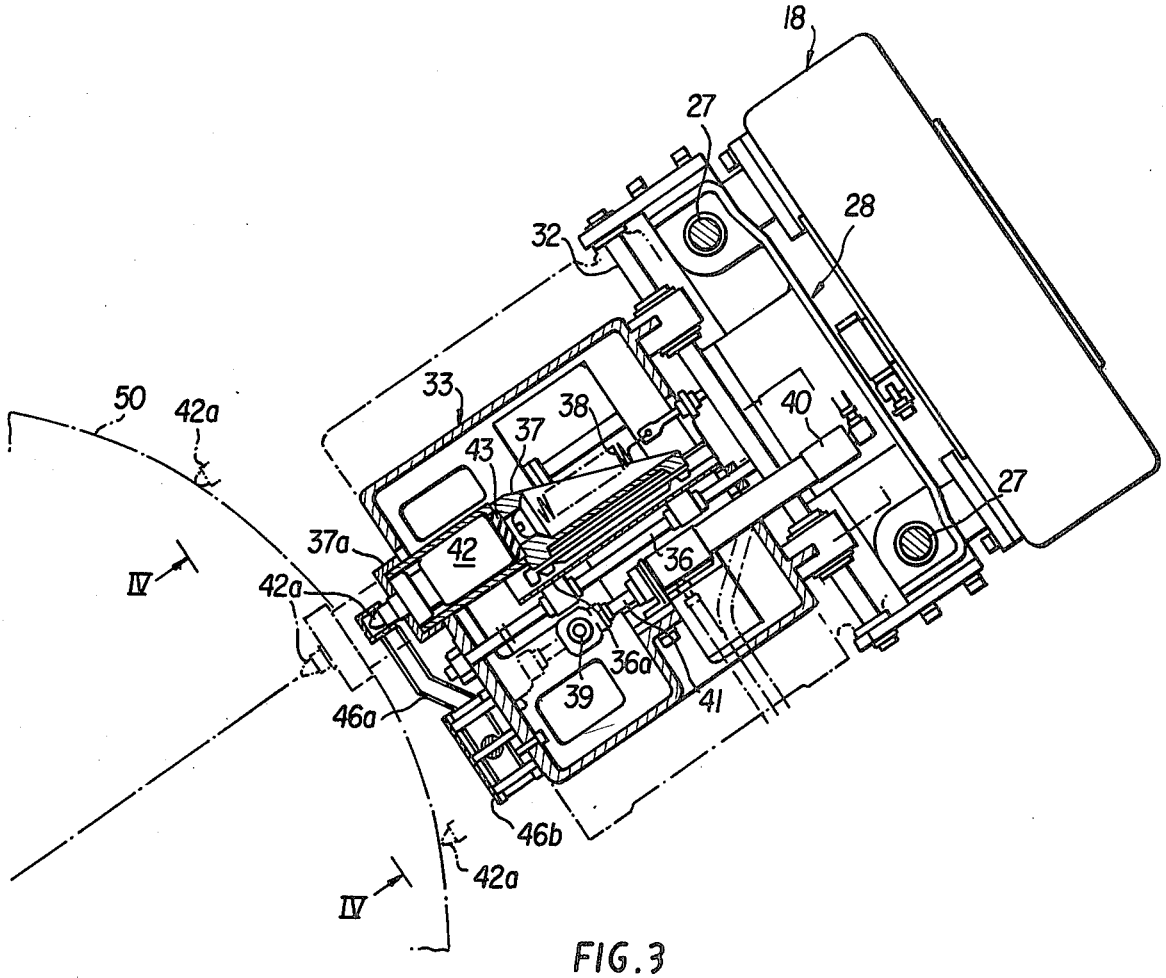
FIG. 3 is a sectional view taken along the line III—III of FIG. 2.

As will be seen from FIG. 3, a guide member 36*a* is slidably mounted on the marking head 33, through a guide shaft 36, and is slidably engaged by a marking material holder 37. A spring 38 provided at the rear end of the marking material holder 37 exerts a force for downwardly biasing the latter, as viewed on FIG. 3.

A rod 41 of a cylinder 40, which is fixed to the marking head 33 through a pin 39, is connected to the guide member 36*a*. The arrangement is such that the marking material holder 37 is moved (i.e. retracted) upwardly as the cylinder 40 is actuated. A so-called magic ink element 42, which is the marking material, is received by the marking material holder 37 through the medium of felt. A screw cap 37*a* screwed to the end of the holder 37 is adapted to prevent the marking material from engaging the holder 37. The end 42*a* of the magic ink element 42 projects outwardly through the screw cap 37*a*.

Figure 4:
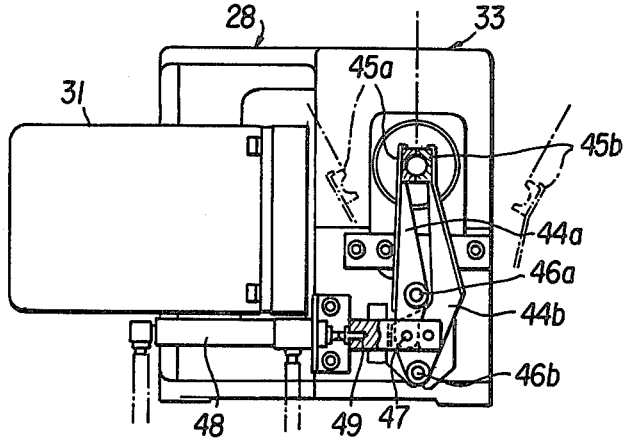
FIG. 4 is a perspective view of the marking device as viewed in the direction of the arrows IV—IV of FIG. 3.

As will be seen from FIG. 4, a pair of cap levers 44*a*,44*b*, each carrying half of a split cap 45*a*,45*b* are rotatably mounted on the marking head 33, through pins 46*a*,46*b*. A cylinder 48 fixed to the marking head 33 has a rod 49 which is connected through a pin 47 to the cap levers 44*a*,44*b*. The arrangement is such that the cap levers 44*a*,44*b* are rotated around the pins 46*a*,46*b*, as the cylinder 48 is actuated, so as to open the cap 45*a*,45*b* at the time of the marking and to close the same as the marking is finished, thereby to covering the end 42*a* of the magic ink element 42, held by the marking material holder 37, so that evaporation of the ink during the suspension of the marking is avoided. In the drawings, the material on which the mark is to be placed, i.e. a coiled strip, is designated by reference numeral 50.

Hereinafter, explanation will be made as to how the marking is effected by the marking device 1 having the described construction.

As the material (coiled strip) 50 is brought to a predetermined position by a conveyor (not shown), the motor 6 disposed at the lower portion of the guide post 2 is started so as to lower the carriage 13 and, accordingly, the horizontal arm 18 is carried by the latter along the guide projections provided at both sides of the guide post 2.

As the horizontal arm 18 is lowered, the roller 21 of the detector 20 secured to the end of the horizontal arm is brought into contact with the outer peripheral surface of the coil 50, and is pushed back, overcoming the force of the spring 19, so that the limit switches 23*a*, 23*b* are operated by the lever 22.

As the limit switches are operated, the motor 6 is stopped so as to cease the downward movement of the horizontal arm 18. Then, the motor 25 on the horizontal arm 18 is started to move the crosshead 28 in the longitudinal direction of the horizontal arm, i.e. in the x-axis direction. At the same time, the motor 31 on the crosshead is also started to cause movement of the marking head 33 in the direction (i.e. y-axis direction) perpendicular to the direction of movement of the crosshead 28. Simultaneously, the cylinder 48 on the marking head 33 is actuated to open the cap 45*a*,45*b*. Then, the cylinder 40 is actuated and the marking material holder 37 is moved ahead by the force of the spring 38, so as to press the end 42*a* of the magic ink element 42 against the outer peripheral surface of the coil 50 to thereby effect the marking.

In this state, the detector 20 and the marking head 33 are inclined to the horizontal plane at an angle of 45° so that they are correctly opposed to the predetermined marking positions (a rear portion of the coil 50, 45° apart from the horizontal plane) of the successive coils, even if the diameter of the coil is varied.

Supposing that the mark consists of three lines: a first line representing the container number, a second line representing the packing number and a third line representing the weight or the like numeral, the motor 15 on the carriage 13 is actuated to move the horizontal arm 18 up and down so as to bring the marking head 33 to the positions corresponding to these lines. As the marking is completed, the cap 45*a*,45*b* is closed to cover the end 42*a* of the magic ink element 42, and the horizontal arm 18 is moved upward and away from the marking position, so as to prepare for the marking operation on the next material.

Figure 5:
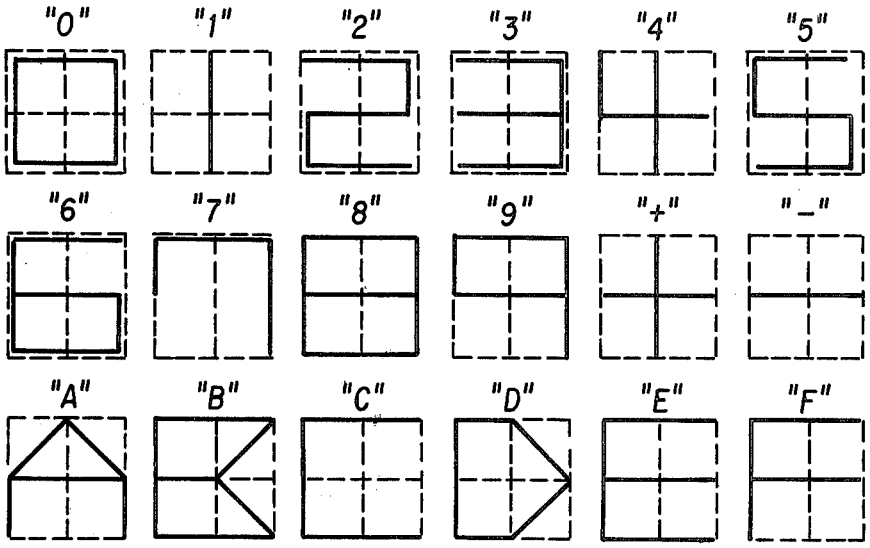
FIG. 5 illustrates how the numerals and letters to be marked are respresented by means of parts of ⊞-shaped pattern.
Figure 6:
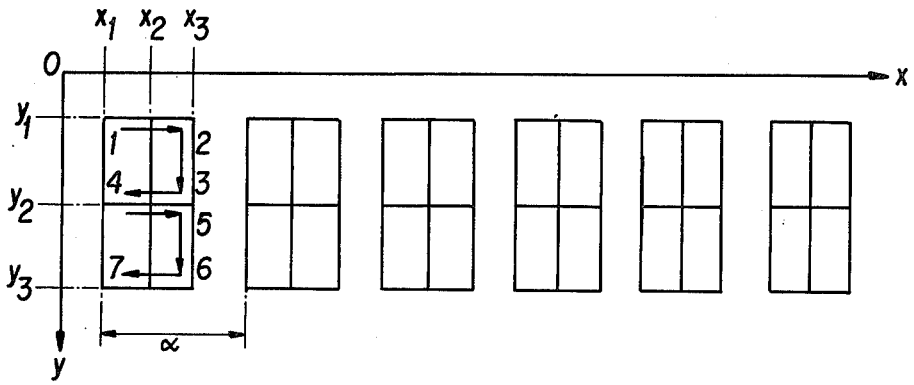
FIG. 6 is an illustration of points on x and y-axes for defining the numeral "3" by means of the ⊞-shaped pattern as shown in FIG. 5, and FIGS. 7 to 9 are block diagrams of a control system for the marking device of the invention.

In the marking device of the invention, the numerals and symbols to be marked are expressed by portions of a ⊞-shaped scanning pattern as shown in FIG. 5. The magic ink element 42 is made to scan this pattern and is pressed against the coil when it moves along a line of the pattern which constitutes a part of the desired numeral, letter or other symbol, so that the desired mark may be put on the outer peripheral surface of the coil 50.

More specifically, when it is required to put the numeral 3 as the mark, the shape of the numeral 3 is given by the following seven position instructions. These position instructions are: (1)(x1,y1),(2)(x3,y3),(3)(x3,y2), (4)(x1,y2),(5)(x3,y2),(6)(x3,y3) and (7)(x3,y3). These position instructions are input to a computer.

Figure 7A:
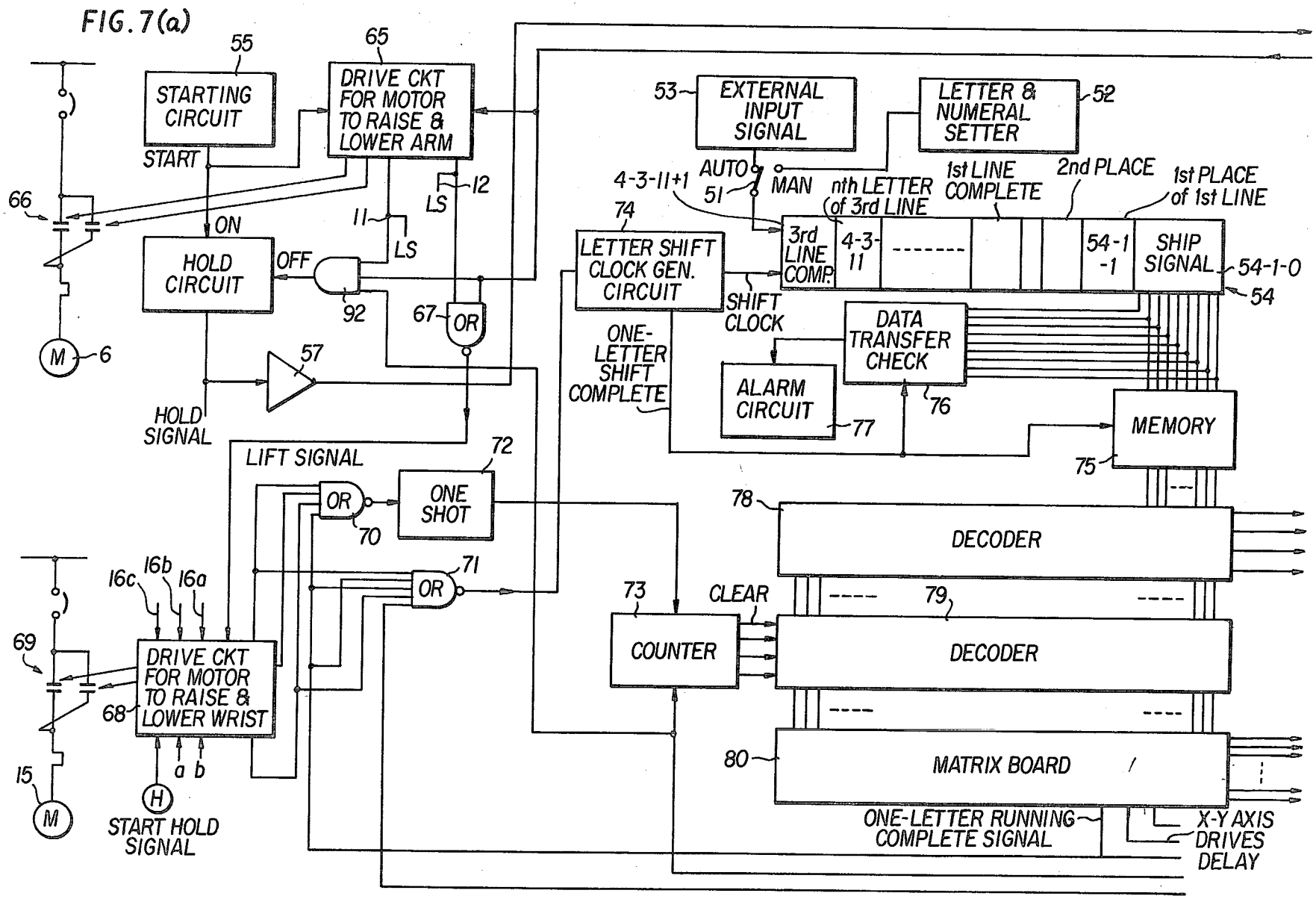
Figure 7B:
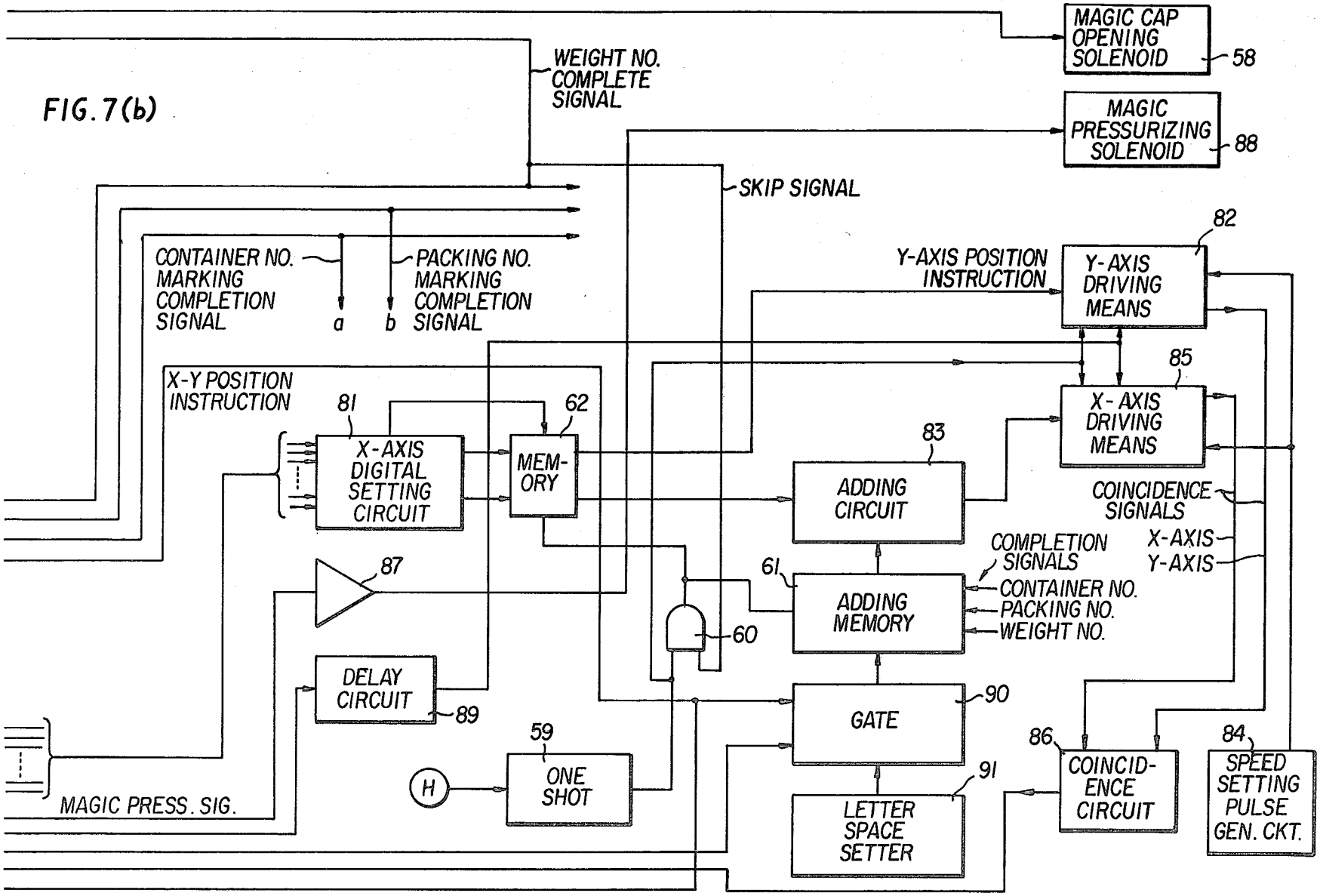

Hereinafter, an explanation will be made as to the automatic marking operation following the above mentioned scanning pattern, with specific reference to FIGS. 7 to 9.

As the coil 50 is stopped at the predetermined position as stated before, a change-over switch 51 is turned for either manual or automatic operation. In case of manual operation, marking informations is input from a letter and numeral setter 52 to a shift register 54 through switch 51, while, when the automatic operation is selected, the marking informations is input from an external signal 53 to the shift register 54.

Upon receipt of the marking informations, the shift register makes a shift on the order of a skip signal, first place of first line, second place of first line . . . n th place of the first line, first line completion signal, first place of second line . . . , second line completion signal, first place of third line . . . , third line completion signal.

After the starting condition is fulfilled as stated above, a start signal is generated by a start circuit 55, and a hold signal is produced by a hold circuit 56. The hold signal is amplified by an amplifier 57 and is used for actuating a solenoid 58 for opening the cap. As the solenoid 58 is energized, the cylinder 48 on the marking head 33 is actuated to swing the levers 44*a*, 44*b* to open the cap 45*a*, 45*b*, to thereby to expose the end 42*a* of the magic ink element 42. At the same time, the above-mentioned hold signal is transferred to a one-shot element 59, the output from of which is input through an OR circuit 60 to an adding memory 61, memory 62 and, as shown in FIG. 9, to up-down counters 82-1, 85-1.

Meanwhile, the above-stated starting signal is delivered to a circuit 65 for driving the motor for moving the horizontal arm up and down, and actuates a conductor and the motor 66 so as to lower the horizontal arm 18. Consequently, the roller 21 provided at the end of the detector 20 mounted at the end of the horizontal arm is brought into contact with the outer peripheral surface of the coil 50 so that the lever 22 operates the limit switch 23.

As the limit switch 23 is operated, the driving circuit 65 for controlling the motor 6 for moving the horizontal arm acts to lower the speed of the motor 6. Then, as the lever 22 comes to operate the lower end limit switch 24, the motor 6 is stopped and a brake (not shown) is actuated to hold the horizontal arm 18 at the lowered position.

The signal from the lower end limit switch 24 is transmitted also through an OR circuit 67 to the driving circuit 68 for the wrist lifting and lowering motor, so that a contactor 69 and the motor 15 on the carriage 13 are actuated. Consequently, the horizontal arm 18 is slid along the carriage 13 to the position corresponding to the first line of the mark.

As the arm 18 arrives at such position, the limit switch 16*a* is turned on to stop the motor 15. Upon receipt of the "ON" signal from the limit switch 16*a*, the circuit 68 for driving the wrist lifting and lowering motor delivers the next step signal (first line) to OR circuits 70, 71. The output from the OR circuit 70 is delivered to a one-shot element 72 which sends a one-pulse signal to a counter circuit 73 to thereby clear the latter.

Meanwhile, the output from the OR circuit 71 is delivered to a letter-shift clock generating circuit 74 which in turn generates a shift clock signal and a one-letter shift completion signal. The shift clock signal is delivered to the aforementioned shift register 54 so as to shift the content of the latter rightward to 8 bits. As a result of this shift, the signal 54-1-1 for the first place of first line is input to a memory $1^{75}$. The one-letter shift completion signal makes the memory $1^{75}$ store the signal 54-1-1 for the first place of first line. The information carried by the signal 54-1-1 is delivered to a data-transfer check 76 so that a parity check is made on the data at a timing of the one-letter shift completion signal. If any error or mistake is found, an signal is delivered to an alarm circuit 77.

The output from the memory $1^{75}$ is sent to a decoder $1^{78}$ which produces an output representing the content (i.e. letter "z", for example) of the aforementioned signal 54-1-1 for the first place of first line. This output is delivered to a decoder $2^{79}$ so as to select the information of the first-place first-line signal 54-1-1 to be marked.

Figure 8:
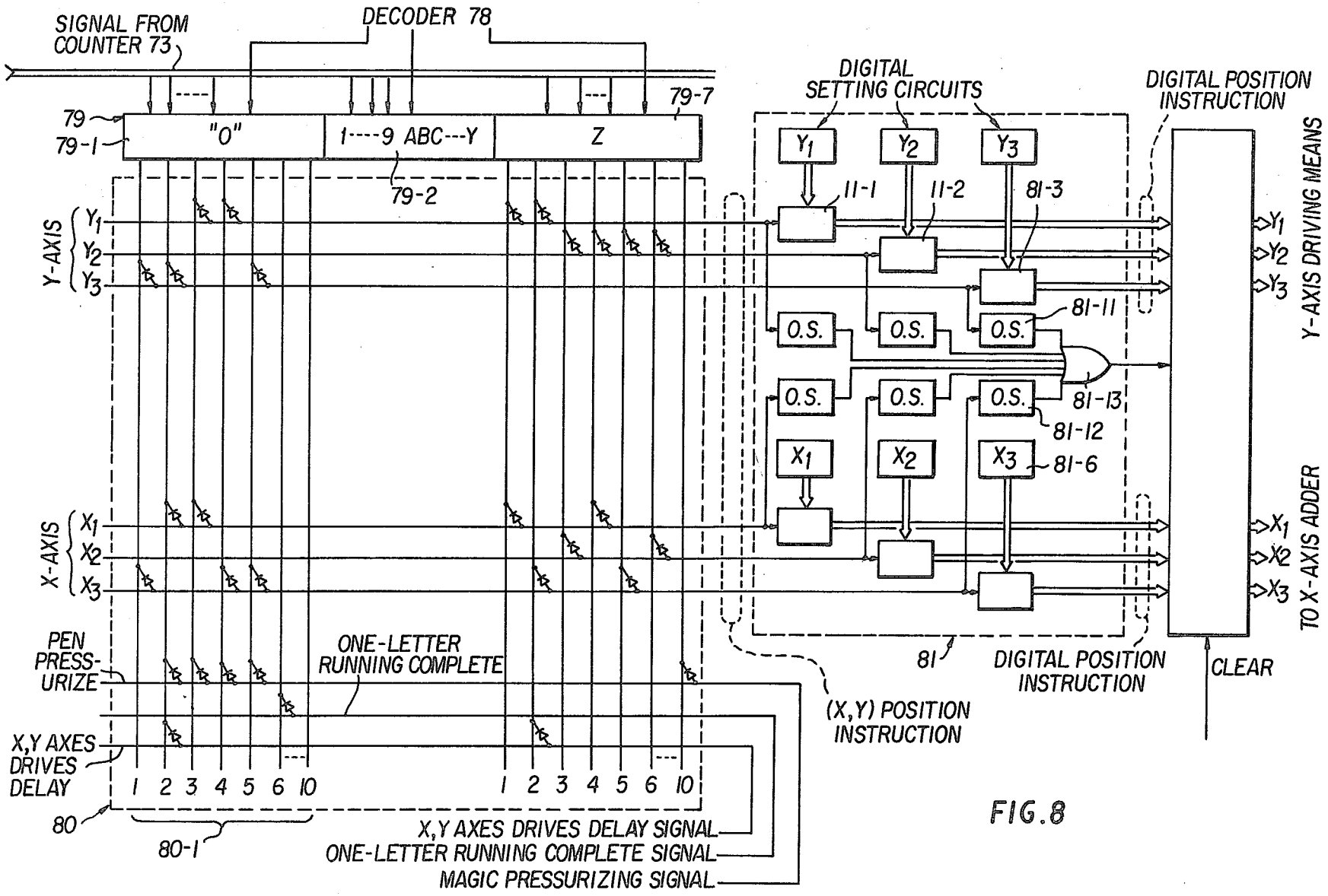

Supposing that the selected letter is, for example, "0" 79-1 as illustrated in FIG. 8, the signal "0" 79-1 is input to a diode matrix 80. Upon receipt of this signal, the first step 80-1 of the diode matrix 80 describes the marking procedure for the letter, and the information of the step (1) is read. The following description is made for explaining the procedure for putting the mark "0".

The (x,y) position instruction x3, y3 of the step (1) is delivered to an x-y axes digital setting circuit 81 so as to open the gates 81-6 and 81-3 of this circuit, as shown in FIG. 8.

Consequently, the digital position instruction x3,y3 is delivered to a memory 2 62. The above mentioned (x,y) position instruction is delivered to one-shot elements 81-11 and 31-12, the output signal of which is delivered to an OR circuit 81-13, so as to output generate a set signal to the memory 2 62. As this set signal is received, the digital position instruction is memorized in the memory 2 62. The memory 2 62 produces a y-axis digital position instruction signal and an x-axis digital position instruction signal which are delivered to a y-axis driving circuit 82 and an x-axis adding circuit 83, respectively.

Figure 9:
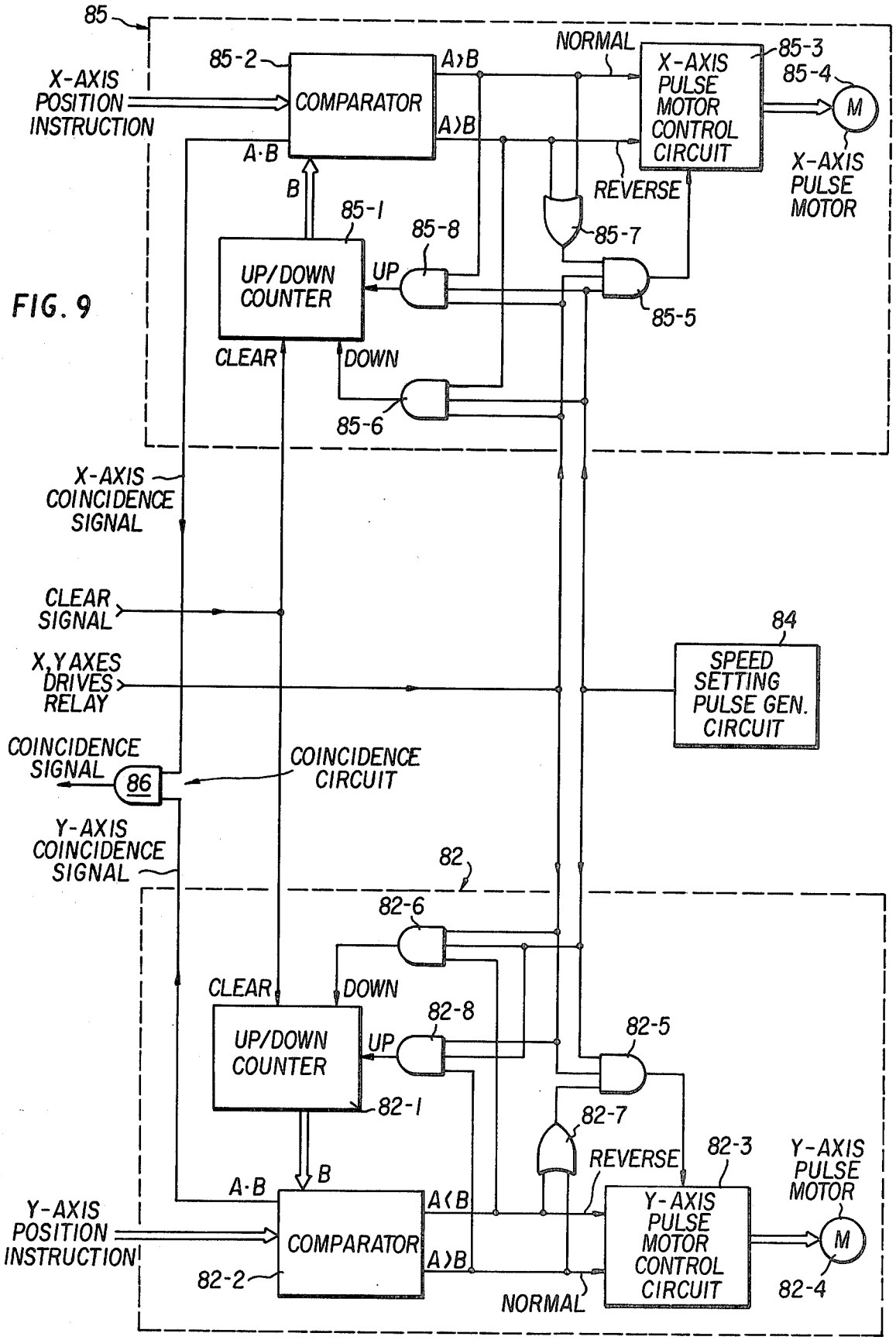

As will be seen from FIG. 9, the y-axis digital position instruction signal is delivered to a comparator 82-2 and is compared in the latter with the signal from an up-down counter 82-1. Since the initial output B from the up-down counter 82-1 is "0", a high-level signal is produced from the comparator 82-2 only when A is larger than B. This high-level signal is delivered to a y-axis pulse motor control circuit 82-3 and an OR circuit 82-7. An AND circuit 82-5 allows a speed-setting pulse generating circuit 84 to generate pulses as long as the high level of the signal from the OR circuit 82-7 is maintained. These pulses are input to the y-axis pulse motor control circuit 82-3.

The above mentioned control circuit 82-3 functions to cause angular movement in perpendicular to the direction of the motor shaft of the y-axis pulse motor 82-4, upon receipt of the output (A>B reverse) from the comparator 82-2 and the output pulses from the AND circuit 82-5, by an angle corresponding to the number of pulses received. Thus, provided that the pulse motor is designed to make an angular movement by 1.8° for each pulse, the motor shaft is rotated by 9° when 5 pulses are received. At the same time, as the output A>B signal from the comparator 82-2 is received, an AND circuit 82-8 produces a signal identical to the output from the AND circuit 82-7. This output is delivered to the above mentioned up-down counter 82-1 to increase the content of the latter.

As the comparator 82-1 generates a signal representing A=B (high level), the signal A>B comes to assume the low level, so that the AND circuit 82-5 stops generating its output to thereby stop the pulse motor 82-4 (i.e. motor 31).

Meanwhile, the x-axis positional instruction signal is added to the content from the adding memory 61 (this output is initially 0). The adding memory then inputs the x-axis position instructional signal to the x-axis driving means 85 which functions, upon receipt of this signal, in the same manner as the y-axis driving means 82 so as to drive and control the x-axis pulse motor 85-4 (motor 25), to thereby shift the position of the marking head 33 in the direction of x-axis.

After the completion of this x-y axes operations, the comparators 82-2 and 85-5 produce x and y-axis coincidence signals which are sent to a coincidence circuit 86. As a result of this input, the output signal from the counter circuit 73 is delivered to a decoder 2 72 which sends a signal for selecting the step (2) of the mark "0" to the diode matrix 80. The information of this step (2) are the signals of the pressure applied to the magic ink element, delay of x and y-axes drive, x1 and y3 positions and so forth.

The magic-ink element pressurizing signal is delivered from the diode matrix 80 to the amplifier 87. The amplified signal is then delivered to a pressurizing solenoid 88 and keeps the latter energized as long as the step (2) is kept selected. The x and y-axes drive delay signal is sent to a delay circuit 89 which produces a signal for blocking the signal input to the AND circuits 82-5, 85-5 of the x and y axis driving means 82, 85, until the magic ink 42 is completely lowered. The x1, y1 position signals of the step (2) are processed in the same manner as those of the step (1).

The markings of the steps (3) to (5) are performed in the same manner as step (2). Then, as the final step (6) is selected, a one letter running completion signal is delivered from the diode matrix 80 to a gate 90 and the aforementioned OR circuits 70 and 71. Consequently, the gate is opened to allow digital information from a space setter 91 to be stored in the adding memory 61. The output from the OR circuit 70 is delivered to the aforementioned counter circuit 73, through the one-shot circuit 72 to thereby to clear the content of the counter circuit 73.

Meanwhile, the output from the OR circuit 71 is sent to the shift register 54 through the aforementioned letter shifting clock generating circuit 74 so as to shift the second letter rightward on the register 54 in the same manner as the first letter. The marking of the second letter, i.e. in the second place, is effected in the same manner as the first letter.

The first to n th places are marked in the manner as described above. Then, the first line completion signal is shifted rightward on the shift register 54. Upon receipt of the shift signal, the decoder $1^{78}$ delivers a first line marking (i.e. container number) completion signal to the adding memory 61 and to the circuit 68 for driving the wrist lifting and lowering motor. The content of the adding memory is cleared by this completion signal and the adding memory 61 delivers a 0 (zero) signal to the adding circuit 83.

As the signal is received by the driving circuit 68, the latter starts the motor 15 on the carriage 13 through the contactor 69, so as to lift the horizontal arm 18 to thereby bring the marking head 33 from the position of the first line to the position of the second line.

As a result, the limit switch **16*b* carried by the carriage 13 is operated to stop the motor. At the same time, a marking instruction signal for the first place of the second line is delivered from the drive circuit 68 to the OR circuits 70, 71. As this signal is generated, the marking for the first to n th places of the second line is performed in the same manner as the first line, and the second line completion signal is shifted to the right on the shift register 54, as is the case of the first line. Then the decoder $1^{78}$ delivers a signal representative of the completion of the second line marking (i.e. packing number) to the adding memory 61 and the wrist lifting and lowering motor driving circuit 68. The content of the adding memory 61 is cleared by this signal, and the adding memory issues a "0" signal to the adding circuit 83**.

The driving circuit 68, upon receipt of the signal, starts the motor 15 on the carriage 13 so as to move the horizontal arm upward in the manner as described before to bring the marking head from the position of the second line to the position of the third line. As a result, the limit switch **16*c* of the carriage 13 is operated to stop the motor 15 and delivers a signal for instructing the marking of the first place of third line to the OR circuits 70 and 71**. Then the marking is performed for the first to n th places of the third line.

Subsequently as the signal representative of the completion of the third line marking is shifted to the right on the shift register 54, the decoder $1^{78}$ delivers a signal representative of the completion of the third line marking (i.e. weight number) to the adding memory 61, the driving circuit 65 for driving the motor for moving the horizontal arm up and down, the AND circuit 92, and the OR circuits 60, 67.

Consequently, the content of the adding memory 61 is cleared, and the latter delivers a "0" signal to the adding circuit 83. At the same time, the output from the OR circuit 60 acts to start the motor 15 on the carriage 13, in the same manner as described hereinabove so as to move the marking head 33 from the position corresponding to the third line to the position corresponding to the second line. In this case no output is delivered to the OR circuits 70, 71.

Upon receipt of the above-stated completion signal, the driving circuit 65 for driving the motor for moving the horizontal arm up and down delivers an instruction for upward movement so that the motor 6 at the lower end of the guide post 2 is started to lift the carriage 13 along with the horizontal arm 18. The limit switch 11 provided at the upper end of the guide post 2 is then depressed by the horizontal arm so that the motor 6 is stopped and ceases the upward movement of the horizontal arm 18.

The AND circuit 92 delivers a signal for dismissing the holding of the signal to the hold circuit 56 upon receipt of the signal from the limit switch 11, the output signal from the coincidence circuit and the above-stated completion signal. The amplifier 57 is turned off by this signal so that the solenoid 58 for opening the cap is deenergized to allow the cap **45*a*, 45*b* to close to thereby cover the end 42*a* of the magic ink 42**.

The output from the above stated OR circuit clears the contents of the memory 2 62 and adding memory 61 so as to turn the x and y-axis position signals to "0". Consequently, the x and y-axes operations are returned to the origin O, and x and y-axis coincidence signal is delivered to the coincidence circuit 86.

In case that a skip signal is set in the marking letter, the decoder $1^{78}$ delivers a skip signal to each of the gate 90 and the OR circuit 71, as the skip signal is input to the memory 1 75. The gate is opened by this output so as to allow the digital information from the space setter 91 to be stored in the adding memory 61. At the same time, the above-stated signal is delivered through the OR circuit 71 to the letter shifting clock generating circuit 74. The shift register 54 is shifted rightward by one letter space by the output from the circuit 74. It will be seen that the skipping signal is used when it is desired to put a vacant space between the letters of successive places. However, the skip signal 54-1-1 which is initially input to the shift register has no significance because the content of the shift register is shifted by one letter space when the marking is started.

After a cycle of marking operation has been finished, the marking head 33 is held at the uppermost position of its stroke, preparing for the marking on the oncoming material.

In the described embodiment, a ⊞-shaped scanning pattern is used for representing the letters, numerals and symbols to be marked. This pattern is, however, not exclusive and various patterns which express the letters, numerals and symbols by x and y-axes components can be used.

As has been described, according to the invention, there is provided a marking device including a guide post having guide surfaces and inclined to the vertical plane, a horizontal arm adapted to be moved up and down along said guide surfaces, a detector for detecting the material on which the mark is to be put and carried by the horizontal arm, movable back and forth in the direction perpendicular to the material, a crosshead movable along the length of the horizontal arm, a marking head carried by said crosshead movably in the direction perpendicular to the direction of movement of the crosshead, and a marking material carried by the marking head, movable movably in the direction perpendicular to the directions of movements of the crosshead and the marking head.

According to this arrangement, since the horizontal arm and the marking head carried by the horizontal arm are adapted to be moved up and down along the guide post inclined to the vertical plane, it is possible to make the marking head correctly oppose to the constant marking position on the outer peripheral surface of the material, irrespective of the change of the diameter of the successive materials. At the same time, the marking head is held at a position spaced from the material by a constant distance since the movement of the horizontal arm toward the material is ceased upon detecting the material by bringing the detector into contact with the material. Further, since the marking is effected by pressing the marking material onto the material on which the mark is to be placed through driving the crosshead in the longitudinal direction of the horizontal arm and through driving the marking head at a right angle to the direction of movement of the crosshead, the large number of maintenance operators, which have been necessitated by the conventional stencil or stamping marking systems, can be eliminated and the laborers are relieved from the severe problems and dangerous working condition, even when the marking is effected on the hot materials, affording automatic marking with precision.

The use of the magic ink (i.e. quick-drying ink) as the marking material is preferred because it is always available commercially. The undesirable evaporation of ink is avoided due to the provision of the cap which is adapted to expose the end of the magic ink element during the marking operation but covers the same ensuring the suspension of the marking so as to afford longer use of the magic ink element.

Obviously, many modifications and variations of the present invention are possible in light of the above teachings. It is therefore to be understood that within the scope of the appended claims the invention may be practiced otherwise than as specifically described herein.

What is claimed as new and desired to be secured to Letters Patent of the United States is:

1. A marking device comprising:

a guide post having a guide surface and inclined to the vertical plane, a horizontal arm carried by said guide post and movable up and down along said guide surface, a detector for detecting the material on which the marking is to be effected carried by said horizontal arm, movable back and forth in a direction perpendicular to said material, a crosshead movable in a direction along the length of said horizontal arm, a marking head carried by said crosshead, movable in a direction perpendicular to the direction in which said crosshead is moved; and a marking member carried by said marking head, movable in a direction perpendicular to the directions in which said crosshead and said marking head are moved, respectively.

* * * * *